US005483718A

United States Patent [19]

Blehert et al.

[11] Patent Number: 5,483,718

[45] Date of Patent: Jan. 16, 1996

[54] FLOOR SCRUBBING MACHINE HAVING IMPACT ENERGY ABSORPTION

[75] Inventors: Michael L. Blehert, Crystal; Robert A. Geyer, Champlin; Michael S. Wilmo, Crystal, all of Minn.

[73] Assignee: Tennant Company, Minneapolis, Minn.

[21] Appl. No.: 317,175

[22] Filed: Oct. 3, 1994

[51] Int. Cl.[6] ..... A47L 11/282; A47L 11/29

[52] U.S. Cl. ..... 15/50.3; 15/52.1; 15/325; 15/340.2

[58] Field of Search ..... 15/49.1, 50.1, 15/50.2, 50.3, 51, 52, 52.1, 52.2, 79.2, 82, 83, 98, 320, 340.2, 340.3, 340.4, 325

[56] References Cited

U.S. PATENT DOCUMENTS

| | | | |
|---|---|---|---|
| 3,942,218 | 3/1976 | Krier et al. | 15/50.3 |
| 4,490,873 | 1/1985 | Stratton | 15/50.1 |
| 4,654,918 | 4/1987 | Cooper | 15/98 |
| 5,016,310 | 5/1991 | Geyer et al. | 15/49.1 |

FOREIGN PATENT DOCUMENTS

| | | | |
|---|---|---|---|
| 5300860 | 11/1993 | Japan | 15/49.1 |

*Primary Examiner*—Edward L. Roberts, Jr.
*Attorney, Agent, or Firm*—Dorn, McEachran, Jambor & Keating

[57] ABSTRACT

A floor scrubbing machine has a chassis mounted on front and rear wheels and a scrub head attached to the front of the chassis by a system of articulated links. Structure is provided for absorbing the kinetic energy of the moving machine in the event that the scrub head strikes a fixed object. On impact the geometry of the linkage system causes the front wheels to be lifted off the floor, thereby quickly lifting considerable weight. Also, a pair of heavy springs stretch, and parts of the chassis deform elastically. By this structure the kinetic energy is absorbed within the machine. No heavy protective shrouds are needed, and a simple flange along the front edge of the scrub head housing provides adequate stiffness.

17 Claims, 3 Drawing Sheets

28
66
64
68
32
44
34
60
62
50
51
54
56
36
53
48
52
42
46
12
16
18
14
20
24
26
30

FLOOR SCRUBBING MACHINE HAVING IMPACT ENERGY ABSORPTION

BACKGROUND OF THE INVENTION

Floor scrubbing machines are widely used to clean the floors of industrial and commercial buildings. They range in size from a small model which may clean a path ranging from perhaps 15 inches up to 36 inches wide controlled by an operator walking behind it, to a large model cleaning a path as wide as five feet controlled by an operator riding on the machine. In general, these machines have a wheeled chassis which contains, in addition to power and drive means, a tank to hold clean scrubbing solution and a tank to hold soiled solution recovered by a vacuum squeegee system from the floor being scrubbed. A scrub head containing one or more rotating scrub brushes and means to power them is attached to the chassis by an articulated linkage system, and may be located in front of, under or behind the chassis. Each location has certain advantages and disadvantages.

Thus a scrub head located in front of the chassis can reach into corners and clean them more completely than one mounted under or behind the chassis. However, it is more vulnerable to being damaged by collisions with fixed objects. This drawback has typically been addressed by providing such machines with heavy protective shrouds or bumpers either attached to the scrub head or attached to the chassis and made to overhang the scrub head. Some of these layouts interfere with the reach or effectiveness of the head, complicate serviceability, and add weight and cost. On such machines there is a need for a way to protect the scrub head from collision damage without using protective shrouds or heavy bumpers.

SUMMARY OF THE INVENTION

This invention is applicable to a floor scrubbing machine having a scrub head mounted in front of the machine chassis. Such a machine in use has kinetic energy due to its mass and travel velocity. If it collides with a fixed object such as a wall this kinetic energy must be dissipated to bring the machine to rest. The invention provides means to do this by applying several non-damaging methods of absorbing the kinetic energy of the machine. There is no need for structural bumpers or heavy covers.

Most of the energy absorption provided by the invention comes from designing the linkage system which attaches the scrub head to the machine chassis in such a way that if the scrub head hits a solid object such as a wall head-on and therefore stops, the front wheels of the still moving chassis will be lifted off of the ground. The weight distribution of the machine is such that most of the total weight is on the front wheels, so quickly lifting this weight absorbs a substantial amount of kinetic energy. After this energy is dissipated the front wheels drop back to the floor without damage.

There are prior art scrubbers in which the rear wheels leave the ground during a frontal collision, but since the rear wheels typically carry only a small part of the machine weight, these machines dissipate very little energy in this way. However, the arrangement used in the present invention is very effective in energy absorption.

The linkage system of the invention further includes a pair of strong springs arranged so that they stretch during a collision, thereby absorbing a portion of the kinetic energy.

The balance of the energy is absorbed by elastic deformation of various parts in the structure of the machine. Prior art scrubbers have typically used mild steel for these parts.

When it is bent it stays bent permanently. A scrubber utilizing the invention, however, has these parts molded from tough engineered plastics. They are far more resilient than mild steel, and they can be deformed as in a collision and return to their normal shapes afterward. In the process they absorb a substantial amount of energy.

It has been found that a scrubber incorporating the above features can be driven at its normal operating speed into a solid wall without damage. No heavy shroud or bumpers are needed on or over the scrub head, and a simple flange along the front edge of the scrub head housing provides adequate stiffness. This saves cost and complexity, and the scrub head is not restricted in its reach into corners. The invention thus provides a substantial improvement over the prior art.

In all the drawings, certain parts not related to the invention have been omitted for clarity.

DETAILED DESCRIPTION OF THE DRAWINGS

Figure 1:
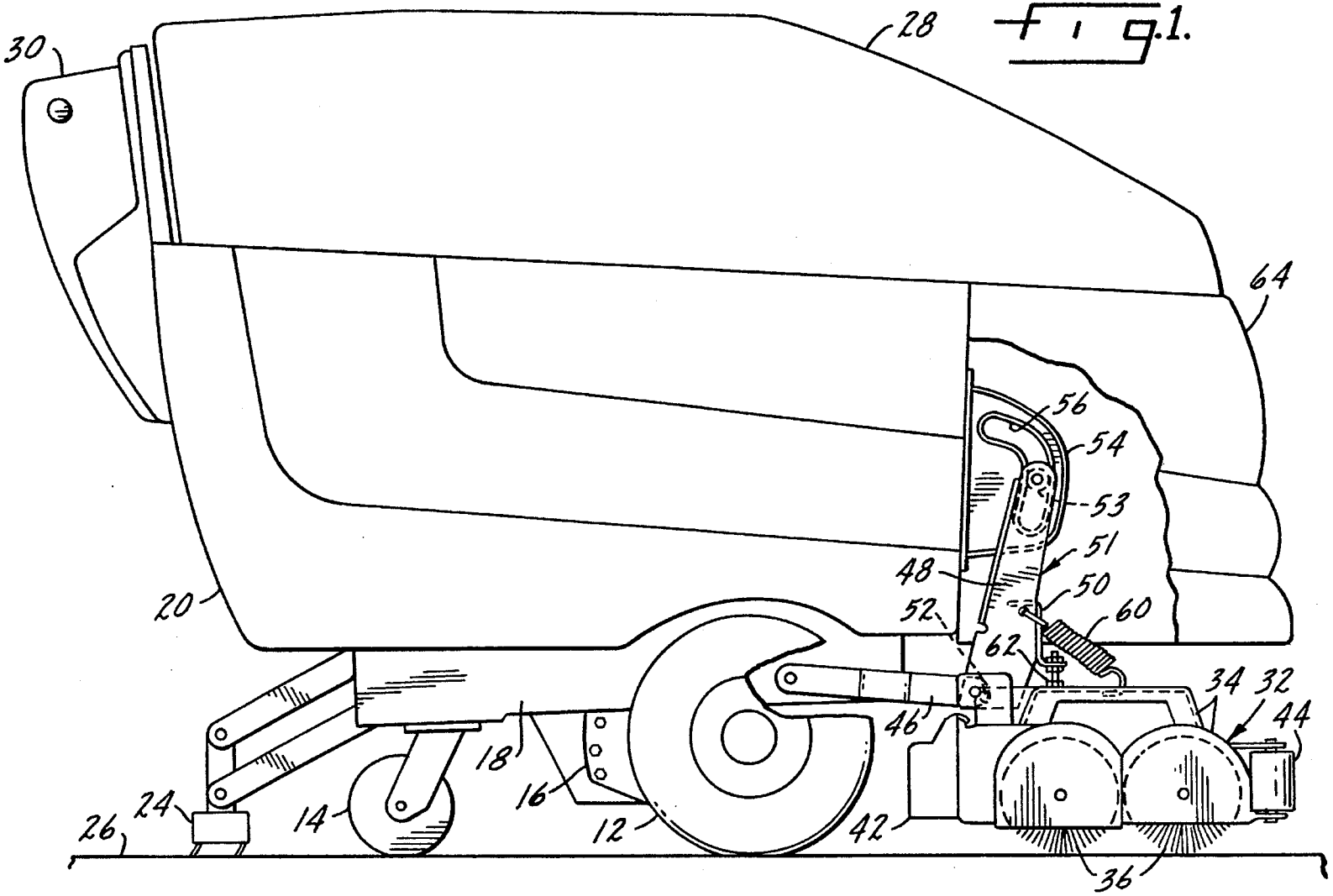
FIG. 1 is a side view of a floor scrubbing machine in which the present invention is used, shown in normal operating position.

A floor scrubbing machine which uses the present invention is shown in normal operating position in FIG. 1. It has two front wheels 12 and two rear caster wheels 14. A transaxle 16 provides traction drive to the front wheels. The transaxle and rear casters are attached to a frame 18, which supports a molded housing 20. This housing encloses rechargeable batteries which supply energy to power the machine. It also contains a recovery tank to hold soiled scrub water recovered by a vacuum squeegee 24 from a floor 26 being scrubbed. A hinged molded lid 28 contains a tank for clean scrubbing solution to be dispensed to the floor and a vacuum fan to lift soiled scrub water from the floor via the squeegee 24 and deposit it in the recovery tank. A control console 30 provides necessary controls for an operator who walks behind the scrubber. All of the above parts might be thought of as the chassis of the machine.

Figure 2:
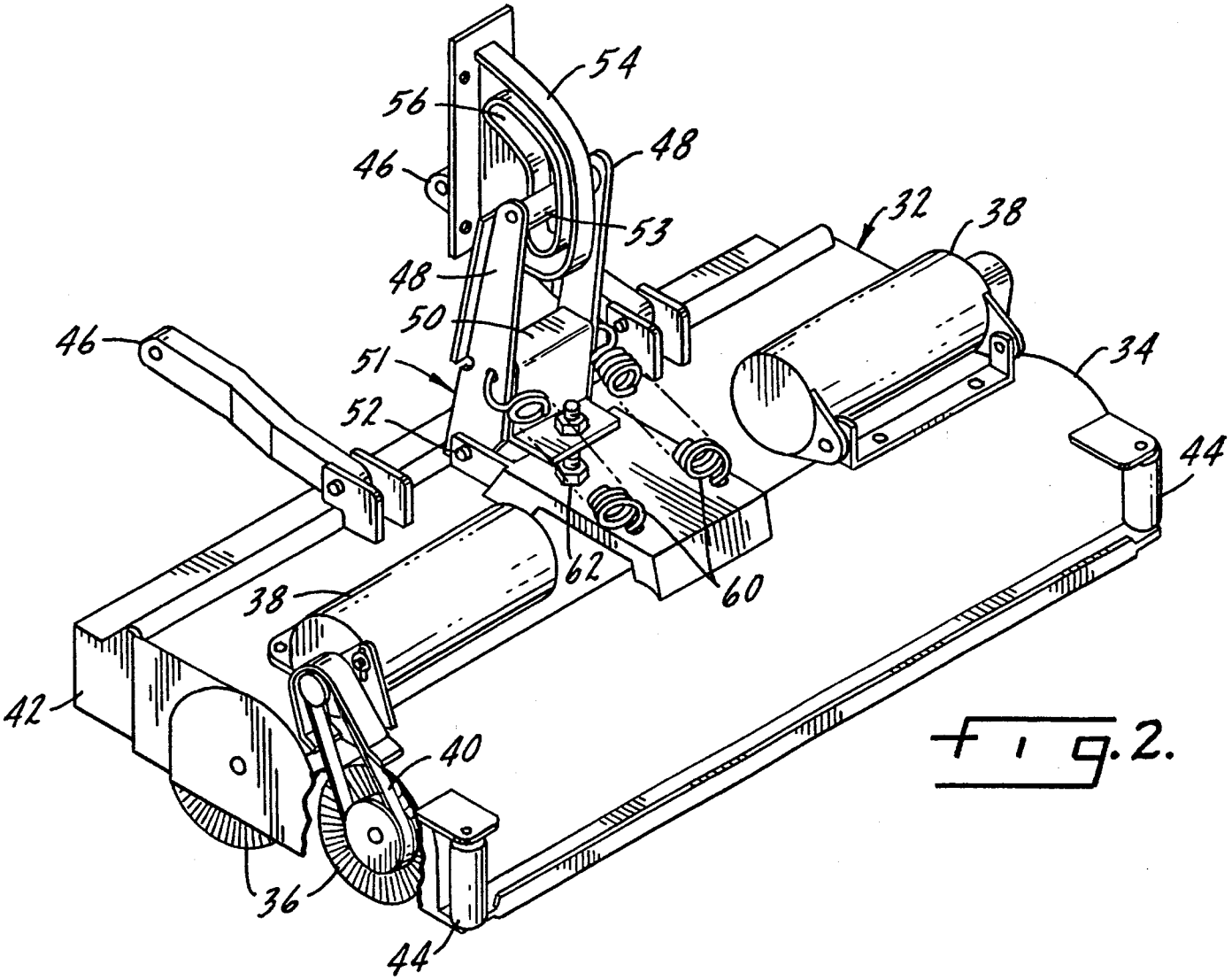
FIG. 2 is an isometric view of the scrub head of the floor scrubbing machine of FIG. 1, showing in clearer detail the arrangement of parts which are involved in the invention.

A scrub head 32 is shown in FIG. 1 in position to scrub the floor 26. A cast aluminum housing 34 encloses two scrub brushes 36. The brushes are driven by two electric motors 38 and belts 40, shown in FIG. 2 but omitted for clarity in FIGS. 1 and 3. A debris tray 42 is removably attached at the rear of the scrub head and serves to catch solid debris that the brushes may sweep up from the floor. Two corner rollers 44 made of an elastomeric material prevent marring a wall if the scrubber is driven close along one, which is common practice. There is an electric actuator attached between the scrub head and the housing 20 which raises the scrub head for transport, lowers it for work, and controls its down pressure on the floor. However, it is conventional and has no bearing on the present invention, so has been omitted for clarity in all of the drawings. Likewise a conventional water distribution system for applying cleaning solution to the floor has been omitted.

The scrub head 32 is attached to the frame 18 by a linkage system which allows it to be raised and lowered and allows the brushes to conform to undulations in the floor. There are two lower links 46, made of a strong engineered plastic material. They are rigid enough to control the position of the scrub head in normal use, but are flexible enough to twist when needed to allow the brushes to conform to an irregular floor, and they can withstand substantial compressive force and impact. They are attached to the frame 18 and the scrub head housing 34 with pivoted connections at their ends.

Two steel arms 48 may be welded to a steel bracket 50, to make a welded assembly 51, or the arms and bracket may be integrally formed. This part 51 is pivotally attached to the scrub head housing 34 at 52. The axis of this pivot is in line with the front pivots of the lower links 46. This is a coincidence, and is not essential, though they would normally be close. An elastomeric roller 53 is rotatably mounted between the arms 48 at their upper ends.

Figure 3:
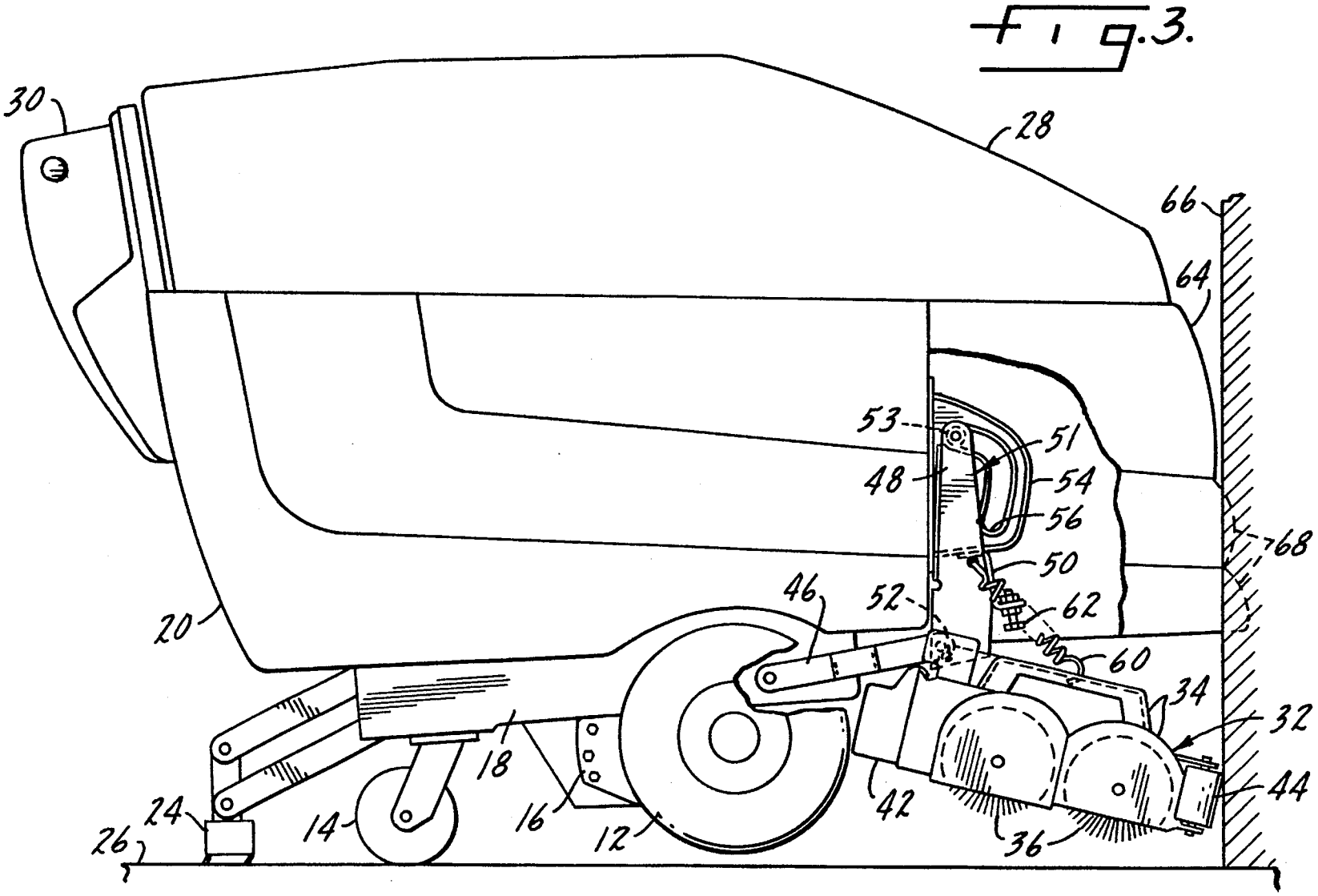
FIG. 3 is similar to FIG. 1, but shows the parts as they would be at the moment of impact when the scrub head has collided with a solid object such as a wall.

Guide 54 is attached to the front wall of the housing 20. It is made of the same tough plastic material as the lower links 46. It provides a slot 56 within which roller 53 can move up and down. This slot has an arcuate lower portion which is generally vertical and an upper portion which slopes up and toward the rear. As shown in FIG. 1, during normal operation roller 53 rides more or less midway in the lower portion of slot 56, where it moves through the same arc as the front pivots of arms 46 to keep the brushes and scrub head parallel to the floor as the scrub head rises and falls while passing over any undulations in the floor. FIG. 3 shows a condition where roller 53 is at the extreme upper end of slot 56. This condition will be discussed in detail later.

Two springs 60 are attached between the scrub head housing 34 and the arms 48. Since the arms are constrained at their upper ends by slot 56 and at their lower ends by pivot 52, the action of springs 60 is to tend to tilt the forward part of the scrub head upward around pivot 52. An adjustable stop bolt 62 is mounted in bracket 50 and bears against scrub head housing 34. It is adjustable to level the scrub head as needed for proper operation.

A decorative enclosure 64 encloses the front end of the machine and is attached to the housing 20. This enclosure, the housing 20 and the lid 28 are molded of polyethylene, a tough plastic that can elastically deform and absorb considerable energy without damage.

Method of Operation

It sometimes happens that through inattention or carelessness an operator will allow a scrubbing machine to collide with a fixed object such as a wall. Then the kinetic energy of the machine must be dissipated to bring the machine to rest. The method of dissipating this energy is the subject of this invention. FIG. 3 shows the scrubber of FIGS. 1 and 2 at the moment of impact with a wall 66. The forward momentum of the machine has applied a force through the lower links 46 against a high point on scrub head 32 at or near pivot 52. This is resisted by the wall 66 acting on corner rollers 44, which are at a lower point on the scrub head. A couple is thus set up which tilts up the rear of the scrub head. The arms 48 move up and the roller 53 moves upward in slot 56 until it strikes the upper end of the slot. Since the upper portion of slot 56 has a substantial rearward direction as well as upward, the arms 48 tilt back while moving up. This tilting of the arms and the tilting of the scrub head combine to stretch the springs 60. These are heavy springs, so in stretching they absorb a substantial amount of energy.

The compressive forces in lower links 46 and in the scrub head 32 have an upward component which is applied at pivot 52 to the arms 48. Through them this upward force is applied through roller 53 to guide 54, and since it is attached to housing 20 a lifting force is applied to the machine which tends to lift the front wheels 12 off of the floor. Much of the weight of the scrubber is on the front wheels. For example, a typical scrubber such as the one shown with a full supply of cleaning solution might weigh on the order of 1300 pounds, with 900 pounds being on the front wheels and 400 pounds being on the rear wheels. It can be seen that quickly lifting the front wheels will absorb a large amount of energy.

FIG. 3 shows a portion 68 of decorative enclosure 64 in dotted lines as having penetrated wall 66. Obviously this does not happen. What does happen is that enclosure 64 is pushed back by the wall and elastically deformed to the extent of its apparent penetration into the wall. This elastic deformation also absorbs a portion of the kinetic energy of the scrubber. After the machine is brought to rest the enclosure 64 returns elastically to its original shape without damage. Some further energy is absorbed in elastic deformation of other parts, also. For example, the forward wall of enclosure 20 flexes slightly where guide 54 is attached to it.

The total effect of these actions is that during a collision the kinetic energy of the scrubber is absorbed within the machine and it is brought to rest without damage. No massive bumpers or heavy shrouds are required.

Alternative Embodiments

The scrubber which has been illustrated and described has a scrub head which uses two cylindrical scrub brushes rotating about parallel horizontal axes. Scrub heads may also be made with only one cylindrical brush,.and are very commonly made with one or more disc brushes rotating about vertical axes. All of these variations can be applied to this invention. It is only required that the scrub head which is used shall be attached to the front of the machine with a linkage system and springs as here described.

The illustrated scrubber is a relatively small model, controlled by an operator walking behind it. Scrubbers are made in much larger sizes, some of which have the operator riding on them. Again, the invention cab be applied to larger machines if the essential elements of the invention are observed.

The illustrated scrubber has its scrub brushes driven by electric motors through belt drives. Other methods are also used, such as, for example, hydraulic drives for the brushes. These variations are immaterial to the invention.

The embodiments of the invention in which an exclusive property or privilege is claimed are defined as follows:

1. In a floor scrubbing machine having a chassis equipped with front and rear wheels, and having a scrub head located in front of the chassis and connected to it by an articulated linkage system, a geometric arrangement of the linkage system such that if while the machine is in motion the scrub head collides with a solid object, the front wheels of the still moving chassis will be lifted off the floor.

2. In a floor scrubbing machine, a chassis, front and rear wheels supporting the chassis, a scrub head, an articulated linkage for attaching said scrub head on a forward portion of said chassis, said linkage being movably connected to said chassis at spaced locations thereon, said linkage being movably connected to said scrub head, whereby during movement of the chassis and scrub head, said movement creating kinetic energy, in the event there is contact between the scrub head and an immovable object, the kinetic energy during such contact being, at least in part, absorbed by raising the forward portion of the chassis through the movable connections of the linkage, chassis and scrub head.

3. The floor scrubbing machine of claim 2 characterized in that the articulated linkage is connected at opposite ends thereof to the chassis.

4. The scrub head of claim 2 characterized in that the movable connection between the scrub head and the articulated linkage is a pivotal connection.

5. The scrub head of claim 2 characterized in that one of the movable connections between the articulated linkage and the chassis is a pivotal connection.

6. The scrub head of claim 2 characterized in that one of the movable connections between the articulated linkage and the chassis provides for upward and rearward movement of a portion of the linkage relative to the chassis.

7. The floor scrubbing machine of claim 2 characterized in that said articulated linkage includes a link pivotally connected to said chassis and pivotally connected to said scrub head.

8. The floor scrubbing machine of claim 7 characterized by a pair of generally parallel links, each pivotally connected to said chassis and each pivotally connected to said scrub head.

9. The floor scrubbing machine of claim 2 characterized in that said articulated linkage includes an arm pivotally connected to said scrub head and movably connected to said chassis for upward movement of said arm.

10. The floor scrubbing machine of claim 9 characterized by a pair of arms, generally parallel, and each pivotally connected to said scrub head and each pivotally connected to said chassis for upward movement of said arms.

11. The floor scrubbing machine of claim 9 characterized in that said chassis includes a guide member, a slot in said guide member, a portion of said arm being movable within said guide member slot to provide for upward and rearward movement of said arm upon contact between said scrub head and an immovable object.

12. The floor scrubbing machine of claim 2 characterized by spring means connected between said articulated linkage and said scrub head for absorbing a portion of the kinetic energy.

13. The floor scrubbing machine of claim 12 characterized in that said spring means is stretched upon contact between said scrub head and immovable object as the forward portion of said chassis is raised.

14. The floor scrubbing machine of claim 12 characterized in that said spring means includes spaced coil springs connected between said scrub head and a portion of said linkage.

15. The floor scrubbing machine of claim 12 characterized in that said articulated linkage includes at least one arm pivotally connected to said scrub head and movably connected to said chassis, said spring means being connected between said scrub head and said at least one arm.

16. The floor scrubbing machine of claim 2 characterized in that said chassis includes a forward portion thereof formed of a material permitting substantial elastic deformation upon contact with an immovable object.

17. The floor scrubbing machine of claim 2 characterized in that upon contact the kinetic energy causes the forward wheels of said chassis to be raised through the movable attachments of said linkage, chassis and scrub head.

* * * * *